United States Patent [19]

Asano et al.

[11] Patent Number: 4,469,581

[45] Date of Patent: Sep. 4, 1984

[54] ELECTROLYTIC ELECTRODE HAVING HIGH DURABILITY

[75] Inventors: Hiroshi Asano, Chiba; Takayuki Shimamune, Tokyo; Hideo Nitta, Kanagawa, all of Japan

[73] Assignee: Permelec Electrode Ltd., Kanagawa, Japan

[21] Appl. No.: 379,699

[22] Filed: May 19, 1982

[30] Foreign Application Priority Data

May 19, 1981 [JP] Japan ..... 56-74296

[51] Int. Cl.[3] ..... C25B 11/00

[52] U.S. Cl. ..... 204/290 F

[58] Field of Search ..... 204/290 F

[56] References Cited

U.S. PATENT DOCUMENTS 3,632,495 1/1972 Beer ..... 204/290 F
3,711,385 1/1973 Beer ..... 204/59 R
3,878,083 4/1975 DeNora et al. ..... 204/290 F
4,110,180 8/1978 Nidola et al. ..... 204/128
4,310,391 1/1982 Okinaka et al. ..... 204/46 G

*Primary Examiner*—John F. Niebling
*Attorney, Agent, or Firm*—Sughrue, Mion, Zinn, Macpeak & Seas

[57] ABSTRACT

An electrolytic electrode having high durability for use in electrolysis where the generation of oxygen occurs, and a process for the production of the electrolytic electrode, the electrolytic electrode comprising: (a) an electrode substrate of titanium or a titanium-based alloy; (b) an electrode coating of a metal oxide; and (c) an intermediate layer comprising an electrically conductive oxide of tantalum and/or niobium, provided between the electrode substrate (a) and the electrode coating (b), in a thickness calculated as the metal, of 0.001 to 2 $g/m^2$.

8 Claims, No Drawings

ELECTROLYTIC ELECTRODE HAVING HIGH DURABILITY

FIELD OF THE INVENTION

The present invention relates to electrolytic electrodes and more particularly to electrolytic electrodes exhibiting excellent durability in electrolysis of aqueous solutions which is accompanied by the generation of oxygen at the anode.

BACKGROUND OF THE INVENTION

Heretofore, electrolytic electrodes using valve metals such as titanium as a substrate have been used as excellent insoluble metallic electrodes in the field of electrochemistry and in particular, have been widely used as chlorine-producing anodes in the salt-electrolytic industry.

The term "valve metal" is used herein to indicate titanium, tantalum, niobium, zirconium, hafnium, vanadium, molybdenum, and tungsten.

Metallic electrodes of the above type are well known as described in, for example, U.S. Pat. Nos. 3,632,498 and 3,711,385 and are produced by coating metallic titanium with various electrochemically active materials such as platinum group metals and the oxides thereof. They retain a low chlorine overvoltage for long periods of time as electrodes for the production of chlorine.

However, when these metallic electrodes are used as anodes in electrolysis for the production of oxygen, or in electrolysis accompanied by the generation of oxygen, a serious problem arises in that the anodic overvoltage gradually increases and, in extreme cases, as a result of passivation of the anode, it becomes impossible to continue the electrolysis. Passivation of the anode is believed to be caused mainly by the formation of less conductive titanium oxides resulting from the oxidation of the titanium substrate with oxygen liberated from the metal oxide per se coated on the substrate, or by penetration of oxygen or electrolyte through the electrode coating. Furthermore, since these less conductive oxides are formed in the interface between the substrate and the electrode coating, the adhesion of the electrode coating to the substrate is deteriorated resulting in the electrode coating peeling off and finally in breakdown of the electrode.

Electrolytic processes in which oxygen is produced at the anode, or in which oxygen is generated at the anode as a side reaction include electrolysis using a sulfuric acid bath, a nitric acid bath, an alkali bath or the like; electrolytic recovery of chromium, copper, zinc and the like; electroplating; electrolysis of dilute salt solutions, sea water, hydrochloric acid or the like; and electrolysis for the production of chlorate. All are industrially important.

In these applications, however, serious problems as described above occur in the use of metallic electrodes.

In order to overcome these problems, U.S. Pat. No. 3,775,284 discloses a method of providing a barrier layer comprising a platinum-iridium alloy and oxides of cobalt, manganese, palladium, lead, and platinum between an electrically conductive substrate and an electrode coating to thereby prevent the passivation of electrodes due to penetration of oxygen.

The barrier layer prevents diffusion and penetration of oxygen during electrolysis to a certain extent. The substances forming the barrier layer, however, are electrochemically active and react with electrolyte penetrating through the electrode coating, forming electrolytic products such as gas on the surface of the barrier layer. The formation of these electrolytic products gives rise to additional problems in that the adhesion of the electrode coating is deteriorated by the physical and chemical action of products and the electrode coating may peel and drop off. Furthermore, sufficient durability can not be obtained.

In addition, U.S. Pat. No. 3,773,555 discloses an electrode in which a substrate is coated with a layer of oxide of titanium or the like and a layer of a platinum group metal or oxide thereof laminated on each other. This electrode, however, also suffers from the disadvantage that when it is used in oxygen generation electrolysis, passivation will occur.

SUMMARY OF THE INVENTION

An object of this invention is to provide an electrode which has nonpassivating properties particularly suitable for use in electrolysis where generation of oxygen occurs, and which has sufficient durability.

Another object of this invention is to provide a process for the production of such electrodes.

The present invention, therefore, provides:

(1) an electrolytic electrode exhibiting high durability in electrolysis where the generation of oxygen occurs which comprises;
   (a) an electrode substrate of titanium or a titanium-based alloy;
   (b) an electrode coating of a metal oxide; and
   (c) an intermediate layer comprising an electrically conductive oxide of tantalum and/or niobium provided between the electrode substrate (a) and the electrode coating (b) in a thickness, calculated as the metal, of 0.001 to 2 $g/m^2$ to thereby provide electrical conductivity to titanium oxide forming on the surface of the electrode substrate; and (2) a process for the production of the electrolytic electrode described above.

DETAILED DESCRIPTION OF THE INVENTION

Hereinafter all the amounts such as thicknesses of metal oxides and other metal compounds are expressed in terms of the amount of calculated metal contained therein.

The intermediate layer (c) provided between the electrode substrate (a) and the electrode coating (b) is corrosion resistant and electrochemically inactive. The major function of the intermediate layer (c) is to protect the titanium-based electrode substrate, preventing passivation of the electrode, and it also acts to enhance the adhesion between the electrode substrate (a) and the electrode coating (b). In accordance with the invention, therefore, electrolytic electrodes can be obtained having high durability sufficient for use in electrolysis for the production of oxygen or in electrolysis where generation of oxygen occurs as a side reaction although it has heretofore been believed difficult to produce such electrolytic electrodes.

The electrode substrate is made of titanium or a titanium-based alloy. Metallic titanium or titanium-based alloys, e.g., Ti-Ta-Nb, Ti-Pd, Ti-Ta, Ti-Nb, Ti-Zr, Ti-Ta-Zr, Ti-Mo-Ni, etc., are suitable, which have heretofore been used in conventional electrode substrates. The electrode substrate may have any desired form, for example, the form of a plate, a porous plate, a bar, or a mesh.

The intermediate layer comprising an electrically conductive oxide of tantalum and/or niobium having a valency of 5 is coated on the electrode substrate in a thickness of 0.0001 to 2 $g/m^2$.

The invention is, as described hereinafter in detail, based on the discovery that providing such a thin intermediate layer between the electrode substrate and the electrode coating permits for the first time the ability to obtain electrodes of sufficient durability which can be practically used as anodes for use in electrolysis where the generation of oxygen occurs.

The amount of the electrically conductive oxide of tantalum and/or niobium coated, i.e., the thickness of the intermediate layer, is very significant and must be within the range of 0.001 to 2 $g/m^2$. When the thickness of the intermediate layer is below 0.001 $g/m^2$, almost no effect due to the presence of the intermediate layer can be observed. On the other hand, when the thickness is above 2 $g/m^2$, for example, within the conventional range of 5.6 to 35 $g/m^2$ as described in, for example, U.S. Pat. No. 3,773,555, the valve metal oxide layer per se is passivated, resulting in passivation of the electrode, and the effect of the invention is not obtained sufficiently.

It has been confirmed that $Ta_2O_5$, $Nb_2O_5$ and a mixed oxide thereof are suitable as substances forming the intermediate layer for achieving the objects of the invention and they produce excellent effects. It is to be noted that the intermediate layer comprises mainly an electrically conductive oxide of tantalum and/or niobium which is not stoichiometric or has lattice defects, although it is described above that $Ta_2O_5$, $Nb_2O_5$ and a mixed oxide can be used as intermediate layer-constituting substances.

A preferred method of forming the intermediate layer is a thermal decomposition method in which a solution containing salts of the foregoing metals is coated on the substrate and heated to form the oxides thereof. Suitable salts of tantalum and niobium which can be used in this method include the chlorides thereof and organic metal compounds thereof such as butyl tantalate and butyl niobate. Conventional application conditions for the solutions can be employed followed by heating, preferably at about 350° to 700° C. in an oxygen containing atmosphere. Of course, any other method can be employed as long as a dense coating of the electrically conductive oxide is formed.

An electrochemically active electrode coating layer is then provided on the intermediate layer coated on the electrode substrate. Substances which can be used in the formation of such electrode coating layers include preferably metal oxides having excellent electrochemical characteristics, durability and the like. Suitable metal oxides can be selected depending on the electrolysis for which the electrode is used. It has been found that substances particularly suitable for use in electrolysis accompanied by the generation of oxygen are one or more oxides of platinum group metals, or mixed oxides of platinum group metals and valve metals. Typical examples are iridium oxides, iridium oxides-ruthenium oxides, iridium oxides-titanium oxides, iridium oxides-tantalum oxides, ruthenium oxides-titanium oxides, iridium oxides-ruthenium oxides-tantalum oxides, ruthenium oxides-iridium oxides-titanium oxides, and the like.

The method of forming the electrode coating is not critical, and various known methods such as a thermal decomposition method, an electrochemical oxidation method, and a powder sintering method can be employed, e.g., as described in U.S. Pat. Nos. 3,632,498; 3,711,385; 3,773,555; 3,775,284; etc. In particular, a thermal decomposition method as described in detail in U.S. Pat. Nos. 3,632,498 and 3,711,385 is suitable. The thickness is not critical and usually is about 0.1 to 20$\mu$, more generally 1 to 5$\mu$.

It is not clear theoretically why the above described excellent effects can be obtained by providing the intermediate layer comprising the electrically conductive oxide of the valve metal having a valency of 5 between the titanium-based electrode substrate and the electrode coating comprising the metal oxide in a thickness of 0.001 to 2 $g/m^2$. It is believed, however, that the effects of the invention are obtained for the following reasons.

As described hereinbefore, passivation of an electrode produced using titanium, for example, as a substrate is caused mainly by the formation of less electrically conductive titanium oxide $TiO_2$ on the surface of the titanium substrate through the oxidation of titanium.

The first requirement for the prevention of passivation is to minimize the formation of the titanium oxide by the provision of a coating barrier layer.

The production of electrodes, however, usually includes a step of forming an electrode coating by heating in an oxygen-containing and high temperature atmosphere. More or less, therefore, titanium oxide is formed on the surface of the titanium substrate. When the electrode is used as an anode in an aqueous solution, for example, the anode substrate is placed under severe oxidizing conditions along with an electrolyte passing through holes of the electrode coating, etc. Furthermore, it may be oxidized by the oxygen contained in the anode coating comprising the metal oxide. In any case it is quite difficult to prevent completely the formation of titanium oxide.

Accordingly the second requirement is to insure the electrical conductivity of the titanium oxide, which is inevitably formed, remains by any suitable means.

The provision of the intermediate layer in the thickness of 0.001 to 2 $g/m^2$ in accordance with the invention permits full achievement of the first and second requirements for the prevention of passivation. That is, the coating of the intermediate layer comprising the dense valve metal oxide protects the substrate from oxidation and minimizes the formation of the titanium oxide. In addition, the titanium oxide formed during the production and use of the electrode is converted into a semiconductor by diffusion of the valve metal having a valency of 5 ($Me^{5+}$) from the intermediate layer-forming substance in the $TiO_2$ crystal lattice, or replacement by the valve metal in the $TiO_2$ crystal lattice. Thus, sufficient conductivity is provided.

The titanium in the $TiO_2$ crystal is tetra-valent, i.e., $Ti^{4+}$, and addition of $Me^{5+}$ to the $TiO_2$ crystal increases the electrical conductivity thereof. This phenomenon is believed to be based on the Principle of Controlled Valency that partial replacement of the metal (n valency) of a metal oxide in crystal form by a (n+1) valent metal element results in the formation of a donor level in the crystal, and the crystal becomes an n-type semiconductor.

It has been found, further, that since the intermediate layer-forming substrate is a valve metal oxide which is originally a poor conductor, a non-conductive metal oxide is formed at least in the central portion in the conventional coating amounts, though conductivity is retained in the interface between the intermediate layer and the electrode substrate or electrode coating by atomic diffusion, solidification, etc., and passivation thereof proceeds. In accordance with the invention, therefore, the intermediate layer is much thinner than that of conventional layers to thereby solve the problem of passivation of the intermediate layer per se.

Furthermore, the intermediate layer-forming substance of $Ta_2O_5$ and $Nb_2O_5$ have good adhesion to metallic titanium and readily form a solid solution in combination with $TiO_2$ or electrode coating-forming metal oxides, such as $IrO_2$, $RuO_2$, and $IrO_2+Ta_2O_5$. This is believed to increase the steady adhesion between the electrode substrate and the electrode coating and to increase the durability of the electrode.

The invention is described in greater detail with reference to the following examples although the present invention is not to be construed as being limited thereto.

EXAMPLE 1

A commercially available 1.5 mm thick titanium plate was degreased with acetone and etched with a 20% aqueous solution of hydrochloric acid at 105° C. to prepare a titanium electrode substrate. A 10% aqueous hydrochloric acid solution of tantalum tetrachloride containing 10 g/l of tantalum was coated on the substrate, dried and calcined for 10 minutes in a muffle furnace maintained at 450° C. to thereby provide an intermediate layer comprising 0.05 g/m$^2$ of a tantalum oxide on the substrate.

A butanol solution containing 90 g/l of iridium chloride and 210 g/l of titanium chloride was coated on the intermediate layer and calcined for 10 minutes in a muffle furnace maintained at 500° C. This procedure was repeated three times to thereby produce an electrode with an electrode coating comprising a mixed oxide of iridium and titanium.

The thus produced electrode was used as an anode in an electrolyte containing 150 g/l of sulfuric acid at 60° C. Electrolysis was performed at a current density of 100 A/dm$^2$ using a graphite plate as a cathode for accelerated testing of the durability of the electrode. The electrode could be used in a stable manner for 65 hours.

For comparison, an electrode (Comparative Electrode 1) was produced in the same manner as described above except that the intermediate layer was not provided, and additionally, an electrode (Comparative Electrode 2) was produced in the same manner as described above except that a $Ta_2O_5$ layer of a thickness of 5 g/m$^2$ was provided as the intermediate layer. These electrodes were subjected to the same durability testing as described above. In the case of Comparative Electrode 1, passivation occurred in 41 hours and the electrode could not be used further. Also, in the case of Comparative Electrode 2, passivation occurred in 43 hours and the electrode could not be used further.

It can be seen from the above results that the electrode of the invention has markedly improved resistance to passivation and durability, and can be commercially used as an anode for electrolysis where the generation of oxygen occurs.

EXAMPLE 2

Several electrodes were produced in the same manner as in Example 1 except that the electrode substrate, intermediate layer, and electrode coating were varied. These electrodes of the invention and comparative electrodes corresponding to each of the electrodes were subjected to the same accelerated durability testing as described in Example 1. The results obtained are shown in Table 1 below.

TABLE 1

| | | | | Service Life of Electrode (Hours) | | |
|---|---|---|---|---|---|---|
| Run No. | Substrate | Intermediate Layer (Coating Amount, g/m$^2$) | Electrode Coating (Molar Ratio of Metals) | Present Invention | Comparative Example A*1 | Comparative Example B (Amount)*2 |
| 1 | Ti | $Nb_2O_5$ (0.004) | $IrO_2$—$Ta_2O_5$ (70:30) | 209 | 122 | 105 (3 g/m$^2$) |
| 2 | Ti | $Ta_2O_5$—$Nb_2O_5$*3 (0.06) | $RuO_2$—$TiO_2$ (20:80) | 27 | 19 | — |
| 3 | Ti—3Ta—3Nb | $Ta_2O_5$ (0.05) | $RuO_2$—$IrO_2$ (80:20) | 71 | 49 | 41 (10 g/m$^2$) |
| 4 | Ti—3Ta—3Nb | $Nb_2O_5$ (0.07) | $RuO_2$—$IrO_2$—$Ta_2O_5$ (30:30:40) | 100 | 71 | — |
| 5 | Ti | $Ta_2O_5$ (1.0) | $IrO_2$—$Ta_2O_5$ (70:30) | 225 | 122 | 124 (5 g/m$^2$) |

Note:
*1Comparative Example A was an electrode produced in the same manner as for the production of the corresponding electrode of the present invention except that no intermediate layer was provided.
*2Comparative Example B was an electrode produced in the same manner as for the production of the corresponding electrode of the present invention except that the thickness of the intermediate layer was outside the range defined for the present invention.
*3Molar ratio (calculated as metal) of $Ta_2O_5$ to $Nb_2O_5$: 50:50.

It can be seen from the results shown in Table 1 above that the service life of the electrode with the thin intermediate layer provided therein according to the present invention is about 40% longer than to about two times the service lives of the comparative electrode with no intermediate layer provided therein and the comparative electrode with the intermediate layer with a thickness outside the range defined in the invention. That is, the durability of the electrode of the present invention is greatly improved. Thus these results demonstrate that the electrode of the present invention is excellent as an anode for use in electrolysis where the generation of oxygen occurs.

While the invention has been described in detail and with reference to specific embodiments thereof, it will be apparent to one skilled in the art that various changes and modifications can be made therein without departing from the spirit and scope thereof.

What is claimed is:

1. An electrolytic electrode having high durability for use in electrolysis where the generation of oxygen occurs which comprises:

(a) an electrode substrate of titanium or a titanium-based alloy;

(b) an electrode coating comprising a mixed metal oxide selected from the group consisting of $IrO_2$ and $TiO_2$; $RuO_2$ and $TiO_2$; and $RuO_2$ and $IrO_2$; and (c) an intermediate layer comprising an electrically conductive oxide of tantalum, niobium or a mixture thereof provided between the electrode substrate (a) and the electrode coating (b) in a thickness, calculated as the metal, of 0.001 to 2 g/m$^2$.

2. The electrolytic electrode as claimed in claim 1, wherein the titanium-based alloy is Ti-3Ta-3Nb.

3. The electrolytic electrode as claimed in claim 1, wherein the intermediate layer (c) comprises $Ta_2O_5$.

4. The electrolytic electrode as claimed in claim 1, wherein the intermediate layer (c) comprises $Nb_2O_5$.

5. The electrolytic electrode as claimed in claim 1, wherein the intermediate layer (c) comprises a mixed oxide of $Ta_2O_5$ and $Nb_2O_5$.

6. The electrolytic electrode as claimed in claim 1, wherein the electrode coating (b) comprises a mixed oxide of $IrO_2$ and $TiO_2$.

7. The electrolytic electrode as claimed in claim 1, wherein the electrode coating (b) comprises a mixed oxide of $RuO_2$ and $TiO_2$.

8. The electrolytic electrode as claimed in claim 1, wherein the electrode coating (b) comprises a mixed oxide of $RuO_2$ and $IrO_2$.

* * * * *